US008096331B2

(12) United States Patent
Marogna

(10) Patent No.: US 8,096,331 B2
(45) Date of Patent: Jan. 17, 2012

(54) MACHINE FOR FILLING CONTAINERS

(75) Inventor: Renato Marogna, Marmirolo (IT)

(73) Assignee: Weightpack S.R.L., Goito (IT)

( * ) Notice: Subject to any disclaimer, the term of this patent is extended or adjusted under 35 U.S.C. 154(b) by 925 days.

(21) Appl. No.: 11/989,965

(22) PCT Filed: Sep. 15, 2006

(86) PCT No.: PCT/EP2006/009030

§ 371 (c)(1),
(2), (4) Date: Feb. 4, 2008

(87) PCT Pub. No.: WO2007/039074

PCT Pub. Date: Apr. 12, 2007

(65) Prior Publication Data

US 2010/0096041 A1 Apr. 22, 2010

(30) Foreign Application Priority Data

Sep. 20, 2005 (IT) ..... MN2005A0057

(51) Int. Cl.
*B65B 3/04* (2006.01)

(52) U.S. Cl. ..... 141/144; 141/83; 141/104; 141/105

(58) Field of Classification Search ..... 141/83, 141/100, 104, 105, 144
See application file for complete search history.

(56) References Cited

U.S. PATENT DOCUMENTS

| | | | | |
|---|---|---|---|---|
| 3,881,529 | A * | 5/1975 | Mannara | 141/100 |
| 6,079,460 | A * | 6/2000 | Ballan et al. | 141/145 |
| 6,213,166 | B1 * | 4/2001 | Thibiant et al. | 141/100 |
| 6,516,838 | B2 * | 2/2003 | Thibiant et al. | 141/100 |
| 6,546,970 | B2 * | 4/2003 | Gatteschi | 141/105 |
| 6,761,191 | B2 * | 7/2004 | Rosen et al. | 141/144 |
| 6,810,927 | B2 * | 11/2004 | Ronchi | 141/144 |
| 7,011,117 | B1 * | 3/2006 | Carpino et al. | 141/89 |
| 2002/0108676 | A1 | 8/2002 | Gatteschi | |
| 2003/0111130 | A1 * | 6/2003 | Dugdale et al. | 141/100 |
| 2006/0151055 | A1 | 7/2006 | Pasquali et al. | |

FOREIGN PATENT DOCUMENTS

| | | | |
|---|---|---|---|
| DE | 615914 | C | 7/1935 |
| DE | 100 61 418 | A | 8/2002 |
| WO | WO 2006/091159 | A | 8/2006 |

* cited by examiner

*Primary Examiner* — Gregory Huson
*Assistant Examiner* — Nicolas A Arnett
(74) *Attorney, Agent, or Firm* — Modiano & Associati; Albert Josif; Daniel O'Byrne

(57) ABSTRACT

A machine for filling containers, comprising dispensing heads, in which each dispensing head comprises at least two ports, which are connected to respective ducts for feeding different liquids, and is provided with elements for controlling the flow of the ducts which are controlled by automatic control elements which act as a function of the quantity of the individual portions of the different liquids that are meant to be introduced in a container, and are adapted to produce a sequential opening of only one of the ports, so as to fill each container by preset portions of the liquids which access sequentially the container.

5 Claims, 2 Drawing Sheets

MACHINE FOR FILLING CONTAINERS

The present invention relates to a machine for filling containers.

BACKGROUND OF THE INVENTION

It is known that there are machines for filling containers with liquid products which comprise a rotating carousel provided with a plurality of filling stations, each of which comprises a head for dispensing the products to a container which is supported in an underlying position and is further provided with means which ensure exact dosage of the product into the container, such as for example a load cell or a flowmeter.

It is also known that there are liquid products which cannot be placed in mutual contact before they are introduced in the container that is designed to contain them in mixed condition, since the handling of the mixture due to the filling operation might cause phenomena which are incompatible with correct execution of this operation: this is the case, for example, of a very common product such as bleach, which cannot be mixed with the associated additives before it is introduced in the containers, since it would produce so much foam as to prevent correct operation of the filling machine.

In the background art, two or more products of the type specified above are introduced in a container by using filling machines arranged in series, which introduce in the containers the products one after the other, therefore without prior mutual contact; the result that is achieved is correct, but the multiplication of the machines used poses considerable problems in terms of space occupation and costs.

SUMMARY OF THE INVENTION

The aim of the present invention is therefore to provide a filling machine which is capable of introducing in a container two or more liquid products in such a way that their mutual contact occurs only within the container and therefore in such conditions as to exclude any unwanted phenomenon.

This aim is achieved by a container filling machine according to the invention, which comprises the characteristics given in claim 1.

BRIEF DESCRIPTION OF THE DRAWINGS

Further characteristics and advantages will become better apparent from the description of a preferred but not exclusive embodiment of the invention, illustrated by way of non-limiting example in the accompanying drawings, wherein.

DESCRIPTION OF THE PREFERRED EMBODIMENTS

Figure 1:
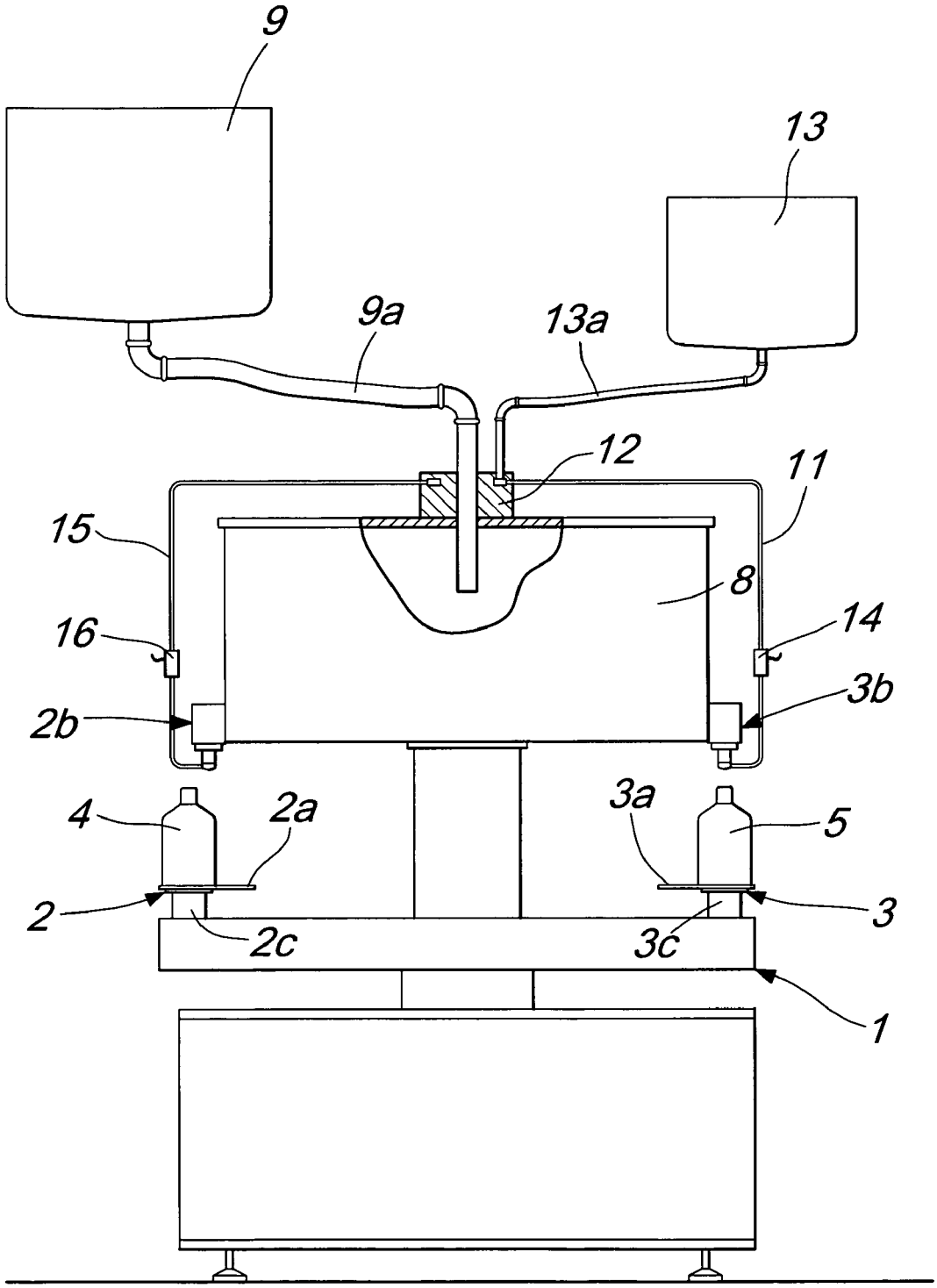
FIG. 1 is a schematic general view of the machine.

With reference to the figures, the reference numeral 1 generally designates a rotating carousel of the machine, which supports a plurality of filling stations 2 and 3, each whereof comprises supporting means such as a supporting pan 2*a*, 3*a* for a container 4 and 5 which is arranged below a head for dispensing liquids 2*b*, 3*b* and is provided with a load cell 2*c*, 3*c*, which ensures the exact dosage of liquids in the container.

Figure 2:
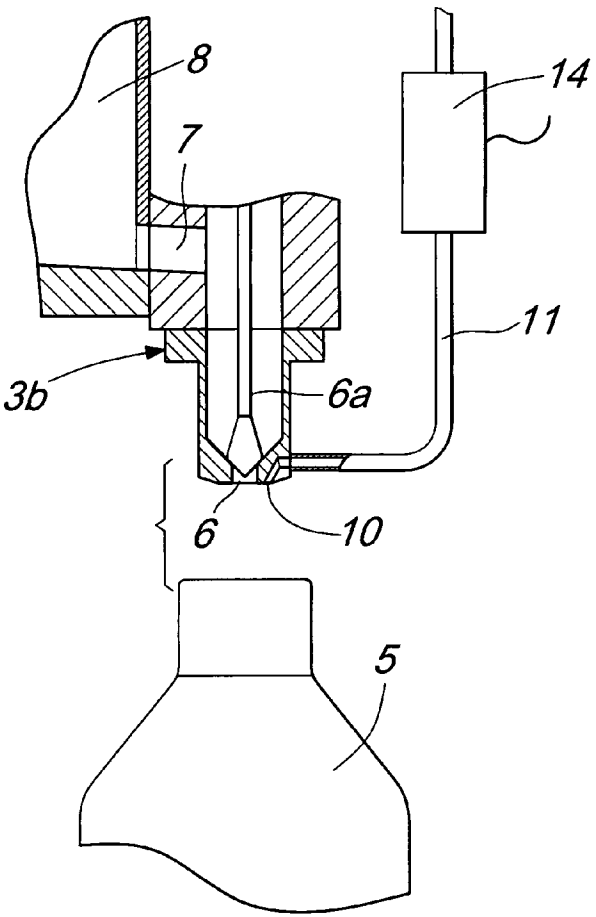
FIG. 2 is a sectional view of a detail of FIG. 1.

All the dispensing heads 2*b*, 3*b* are identical and therefore only the head 3*b* is described in detail with particular reference to FIG. 2.

The head 3*b* comprises at least one first dispensing port 6 which is provided with a flow control element 6*a*, port 6 being connected by means of a duct 7 to a tank 8, which is mounted on the rotating carousel and is designed to contain a first liquid fed from a static tank 9 by means of a duct 9*a*.

The head 3*b* further comprises at least one second dispensing port 10, which is connected to a tube 11 that protrudes from a manifold 12 which is mounted on the rotating carousel and is fed with a second liquid drawn from a static tank 13 by means of a duct 13*a*; a flow control valve 14 is inserted along the tube 11.

For the sake of completeness, it is noted that FIG. 1 shows, and designates with the reference numeral 15, the tube provided with a flow control valve 16 which protrudes from the manifold 12 and feeds the second dispensing port of the head 2*b*.

Going back to the previously cited example, it is noted that the first liquid might be constituted by bleach and the second liquid might be constituted by the associated additives.

Figure 3:
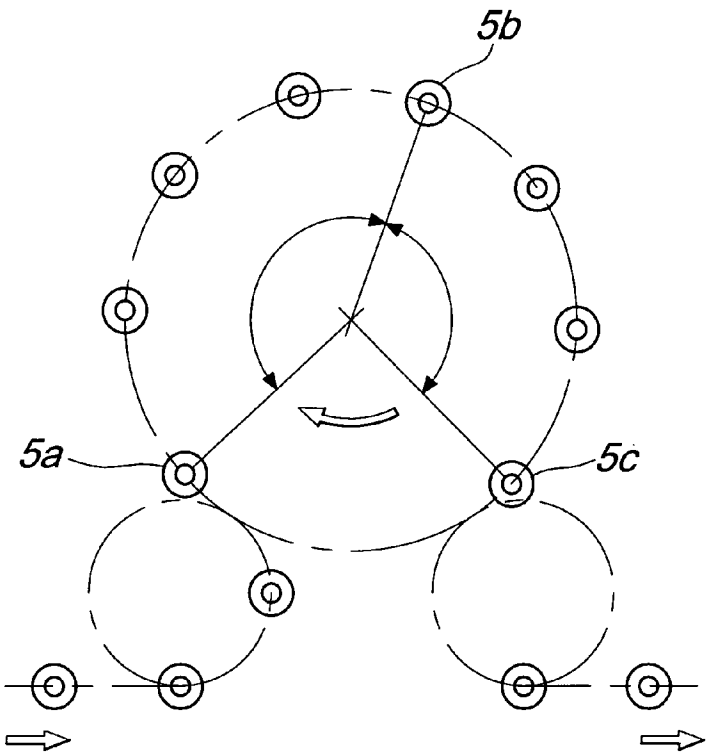
FIG. 3 is a functional diagram of the machine.

The means for controlling the flow through the product dispensing ports of individual heads, constituted for example for the head 3*b* respectively by the flow control element 6*a* and by the valve 14, are controlled by automatic control means which operate as a function of the weight, detected by the load cells provided in each filling station, of the individual portions of the first and second liquids meant to be introduced in a container and determine operating modes which produce the sequential opening of only one of said ports. Thus, again with reference by way of example to the head 3*b*, while the container 5 that lies below said head traces the path between the positions designated respectively by the reference numerals 5*a* and 5*b* in FIG. 3, as a consequence of the rotation of the carousel 1 about the angle A, only the port 6 remains open until the intended weight of the portion of the first liquid that is dispensed to said container is reached, while only the port 10 remains open during the travel of the container between the positions 5*b* and 5*c* following the rotation of the carousel about the angle B, dispensing to the container the portion of the second liquid that has the intended weight.

Accordingly, the container 5 receives first of all a portion of the first liquid that is contained in the tank 8, and only after the end of its access it receives the filling portion of the second liquid that arrives from the manifold 12, so that contact and mixing of the two liquids occurs only within the container; in the case for example of bleach and additives, the formation of foam outside the container is thus excluded.

The described invention is susceptible of numerous modifications and variations, all of which are within the scope of the appended claims: thus, for example, each dispensing head can receive the liquid products conveyed in any manner.

The disclosures in Italian Patent Application No. MN2005A000057 from which this application claims priority are incorporated herein by reference.

What is claimed is:

1. A machine for filling containers, comprising:

a rotating carousel that is rotatable through at least two subsequent rotation angles and is provided with a plurality of filling stations, each one of said filling stations being provided with a respective dispensing head;

supporting means provided at each one of said filling stations for supporting a respective container to be filled in a position that lies below a said dispensing head, the container being movable along a path as a consequence of the rotation of said carousel through said rotation angles;

at least two ducts provided at said carousel for feeding each a different liquid to said dispensing head;

at least two dispensing ports provided in a said dispensing head, each one of said dispensing ports being connected to a respective one of said ducts:

flow control means for independently controlling liquid flow in each one of said ducts;

automatic control means for controlling said flow control means to allow feeding of a liquid flow in each one of said ducts as a function of a quantity of an individual portion of a said different liquid to be introduced in a container, said automatic control means producing a sequential opening of said at least two dispensing ports, one of said dispensing ports being open over one rotation angle and another one of said dispensing ports being open over a subsequent said rotation angle so as to fill each container with a first preset said individual portion of a first liquid and, subsequently, with a second preset said individual portion of a second different liquid, the first and second different liquids accessing sequentially said container.

2. The machine of claim 1, wherein said supporting means comprises a supporting pan for supporting a respective said container, said pan being provided with a load cell that is suitable to ensure exact dosage of a said quantity of an individual portion of a said different liquid.

3. The machine of claim 1, comprising a tank mounted on the rotating carousel for containing said first liquid and a manifold which is mounted on the rotating carousel, wherein one of said ducts protrudes from said tank and is connected to said first dispensing port and a second said duct is constituted by a tube which protrudes from said manifold and is connected to said second dispensing port to feed said second different liquid thereto.

4. The machine of claim 3, wherein said flow control means comprise a flow control element provided at said first dispensing port and a flow control valve fitted on said tube.

5. The machine of claim 3, comprising a further tank mounted on said rotating carousel for containing said second different liquid, said manifold being fed with said second different fluid from said further tank.

* * * * *

UNITED STATES PATENT AND TRADEMARK OFFICE

CERTIFICATE OF CORRECTION

PATENT NO. : 8,096,331 B2
APPLICATION NO. : 11/989965
DATED : January 17, 2012
INVENTOR(S) : Renato Marogna It is certified that error appears in the above-identified patent and that said Letters Patent is hereby corrected as shown below:

Title Page, below Item (75) should read

-- (73) Assignee: Weightpack S.p.a., Goito (IT) --

Signed and Sealed this
Tenth Day of April, 2012

David J. Kappos

David J. Kappos
*Director of the United States Patent and Trademark Office*